United States Patent [19]

Sawyer, Jr.

[11] 4,147,519

[45] Apr. 3, 1979

[54] COAL SUSPENSIONS IN ORGANIC LIQUIDS

[75] Inventor: Edgar W. Sawyer, Jr., Hagerstown, Md.

[73] Assignee: International Telephone & Telegraph Corp., Nutley, N.J.

[21] Appl. No.: 810,121

[22] Filed: Jun. 27, 1977

[51] Int. Cl.[2] ..... C10L 1/32

[52] U.S. Cl. ..... 44/51

[58] Field of Search ..... 44/51, 6; 106/71

[56] References Cited

U.S. PATENT DOCUMENTS

| | | | |
|---|---|---|---|
| 2,125,753 | 8/1938 | Spencer | 44/6 |
| 2,250,287 | 7/1941 | Work et al. | 44/6 |
| 3,210,168 | 10/1965 | Morway | 44/51 |

*Primary Examiner*—Winston A. Douglas
*Assistant Examiner*—Y. Harris-Smith
*Attorney, Agent, or Firm*—John T. O'Halloran; Peter C. Van Der Sluys; Stephen Goldman

[57] ABSTRACT

Suspensions of coal dust powder in fuel oil are stabilized against sedimentation by an additive that makes them viscous under conditions of low shear in order to keep the coal in suspension under static conditions while exhibiting relatively low viscosity under high shear conditions to facilitate pumping through long range pipelines by the combination of a suitable surfactant with a gelling grade clay suspending agent.

15 Claims, No Drawings

COAL SUSPENSIONS IN ORGANIC LIQUIDS

BACKGROUND OF THE INVENTION

The continually escalating cost of fuel oil as an energy source and its predicted depletion suggests the use of other type fossil fuels as fuel oil substitutes. The abundance of coal and its ready accessibility presents the need for an immediate direct substitution of coal for fuel oil wherever possible.

Several factors have retarded the immediate substitution of coal for fuel oil. One such factor is the difficulty in transporting the coal in bulk from the point of origin to the place of intended use. Another important factor to be considered in the substitution of coal for fuel oil is the effect of the coal burning by-products on the ecology. The problem of transporting coal over long distances is covered in copending U.S. Pat. Application Ser. No. 595,471 filed July 14, 1975 now abandoned. This copending application entitled "Stable Particulate Suspensions" is incorporated herein by way of reference. The application provides means for forming stable suspensions of finely divided coal dust in water for efficient transport within long distance pipelines. A third factor which is of paramount importance is the necessity of converting oil burning equipment over to the proper facility for burning coal.

In order to reduce the effect of coal burning on the ecology the coal is not directly substituted for fuel oil as an energy source but rather is partially substituted for some of the fuel oil and is burned in combination with the oil. The addition of finely divided coal dust in a combustible organic liquid is shown in U.S. Pat. No. 1,390,228 issued Sept. 6, 1921. This patent discloses the use of approximately 30% finely pulverized coal dust as an adjunct to fuel oil and teaches the addition of lime-rosin grease as a means to keep the finely divided coal dust in suspension within the oil. In order to transport the coal dust-fuel oil mixture through long distance pipelines, mechanical power must be consumed in order to cause the coal dust slurry to become transported within the pipeline and must be applied at intervals to keep the coal dust slurry in motion up to the point of destination.

The purpose of this invention therefore is to provide stable, economical coal dust-fuel oil slurries that have optimum rheological properties in order to provide stable suspensions while maintaining ease-of-pumping and ease-of-burning characteristics.

SUMMARY OF THE INVENTION

This invention provides economically feasible coal dust-fuel oil suspensions that exhibit psuedoplastic flow properties. The suspensions provide good suspension stability at low shear rates and good pumpability and sprayability at higher shear rates. The addition of low concentrations of a mixture of a gelling grade clay and an organic surfactant to the coal-fuel oil suspension provides stable suspensions that can be stored for long periods of time without settling yet are readily pumpable over long distances without excessive power requirements or loss of stable suspending properties. Furthermore they can be pumped and sprayed through a burner nozzle with facility during the burning step, thus allowing for an easy burner conversion.

GENERAL DESCRIPTION OF THE INVENTION

Although various means have been suggested to suspend finely pulverized coal dust in several grades of fuel oil, the varied and severe demands involved in storing, pumping and spraying the suspensions have heretofore made such existing suspensions commercially infeasible. Thickeners added to the fuel oil to keep the coal dust particles in suspension interfered with the flow properties of the coal dust-fuel oil mix and prevented the suspension from being transported through pipelines and being sprayed to give fine, good burning droplets in the combustion chamber.

This invention therefore satisfies the requirement that the coal dust particles remain in suspension without settling and clogging the pipelines over extended periods of time and further provided good flow properties to the suspension for ease in pumping and spraying. In the aforementioned U.S. Patent Application coal dust suspensions in water provide long range stable suspensions which are easily pumpable over long distances. The coal dust-water suspensions with carefully controlled quantities of a gelling grade clay exhibit psuedoplastic flow. At rest the suspensions have considerable gel structure. At low shear rates the suspensions exhibit high apparent viscosities and are very stable so that when they are not being pumped, for example, as when static in the pipelines or transported in tank cars during shipment, the coal dust particles remain firmly in suspension. At higher shear rates such as those encountered during transport, mixing, pumping and spraying, the suspensions exhibited low apparent viscosities. In order to solve the problems involved with finely pulverized coal dust in organic systems it was determined that the incorporation of small quantities of a gelling grade clay plus an organic surfactant caused the coal dust-fuel oil suspensions to have psuedoplastic properties. In order to form stable, homogeneously gelled dispersions of the coal dust particles in the oil mixtures of gelling grade clays plus various surfactants were investigated to determine systems in which both the coal and clay can be dispersed within the oil with subsequent flocculation.

DESCRIPTION OF THE PREFERRED EMBODIMENT

In the following examples a bituminous coal with a volatile content of 40% and an ash content of 7% was ground in a Raymond bowl mill to 88% finer than 200 mesh. Mobil's #2 fuel oil was employed as the organic liquid and MIN-U-GEL 200, a colloidal attapulgite product manufactured by the Pennsylvania Glass Sand Corporation, was used as the clay. In order to determine the rheological properties of the suspensions the viscosity was measured on a Brookfield viscometer at two different speeds. A viscometer speed of 10 RPM was taken to determine the viscosity of the suspension at low shear rates. A viscosity reading was also taken at 100 RPM as an indication of the flow properties at higher shear rates. The viscosity reading for the suspension at 10 RPM provides a good indication of the stability of the suspension against settling. The viscosity reading at 100 RPM gives an indication of ease-of-pumping and sprayability. A good indication of the desired rheological properties of the suspensions is the "Thixotropic ratio" which is defined by ratio of the viscosity reading in c.p.s. at 10 RPM to the reading at 100 RPM. The minimum 10 RPM viscosity is about 1500 c.p.s. with a minimum thixotropic ratio of about 2/1 for good flow properties without settling. The settling observation is best made visually since the gel strength and anti-caking effect of the added clay determine the degree of hard caking which can be observed when the suspensions are allowed to stand for periods of time without mixing.

The suspensions were formed by two different methods. The first method was pregelling, in which the clay and surfactant were first gelled at a high concentration in oil and then stirred into additional oil and coal to achieve the final formulation. The second method, direct formulation, consisted in the addition of the oil, surfactant, clay and coal while stirring with a high speed mixer. In all the examples tested the pregelling method resulted in higher viscosities in the final mix per given quantity of clay and surfactant. To determine the stability of the suspensions over extended periods of time the viscosity readings were taken initially, after 24 hours, and at the end of one week. They were also stored in jars and visually examined after extended periods.

Pregel Suspensions

In the following two examples three pregels were formulated as follows:

| | | Wt % |
|---|---|---|
| Oil | 352 g | 88 |
| Surfactant | 8 g | 2 |
| Clay | 40 g | 10 |
| TOTAL | 400 g | 100 |

The clay concentration for the pregel was fixed at 10% by weight of the total and the ratio of the clay to the surfactant was fixed at 5/1. The surfactants used in the following examples for dispersing the coal and the clay are as follows:

Varine O (Northern Petrochemical Company). This surfactant is the reaction product of oleic acid and amino-ethylethanolamine. It is described as an imidazoline.

Monazoline T (Mona Industries Inc.). This surfactant is the reaction product of tall oil fatty acids and aminoethylethanolamine and is also an imidazoline.

Tergitol NPX (Union Carbide Corporation). This surfactant consists of dodecylphenol condensed with 8-9 mols of ethylene oxide.

The Varine O and Monazoline T are cationic surfactants while the Tergitol NPX is a nonionic surfactant. In order to evaluate the properties of the following suspensions visual observations are indicated along with the Brookfield viscosity readings. The pregels based on the formulation given earlier are designated A, B and C according to the surfactant used in forming the pregel as follows: A = Monazoline T, B = Tergitol NPX, and C = Varine O.

EXAMPLE 1

| | Controls | | | | Run 1 | | Run 2 | |
|---|---|---|---|---|---|---|---|---|
| | 50% | | 60% | | Pregel B (60%) | | Pregel B (50%) | |
| | | Wt % | | Wt % | | Wt % | | Wt % |
| Oil* | 250 g | 50 | 200 g | 40 | 100 g | 20 | 200 g | 40 |
| Coal Dust | 250 g | 50 | 300 g | 60 | 300 g | 60 | 250 g | 50 |
| Pregel | — | — | — | — | 100 g | 20 | 50 g | 10 |
| Total | 500 g | | 500 g | | 500 g | | 500 g | |
| Clay | 0 | 0 | 0 | 0 | 10 g | 2.0 | 5 g | 1.0 |
| Surfactant | 0 | 0 | 0 | 0 | 2 g | 0.4 | 1 g | 0.2 |
| Clay/Surfactant | — | — | — | — | 5/1 | | 5/1 | |
| | Thin, settled rapidly | | | | Too thick | | Thin | |

*note
where pregels are used additional oil was added in the pregel.
In Run 1 the total oil was 31.6%; in Run 2 it was 48.8%.

| Evaluations | | | | |
|---|---|---|---|---|
| Viscosity, cps 10/100 RPM | | | | |
| Initial | — | 4000/1080 | — | 1000/180 |
| 24 hrs. | Heavy Sludge | Heavy Sludge | — | 900/140 No sediment 10% SN* |
| 1 Week | Settled to a hard cake | Settled to a hard cake | — | 200/108 No sediment 20% SN* |

*SN = clear, supernatant liquid

Runs 1 and 2 of Example 1 indicate that the coal dust concentration of 60% with an added clay concentration of 2% resulted in a suspension that was too thick for pumping. Run 2 of Examples 1 having a coal dust concentration of 50% and an added clay concentration of 1% resulted in a suspension that was quite thin and although the viscosity was low initially, it further decreased substantially after a week with the formation of as much as 20% clear supernatant liquid. The following runs were made with the three surfactants to obtain results on intermediate coal dust concentrations.

EXAMPLE 2

| | Run 3 Pregel A | Wt % | Run 4 Pregel B | Wt % | Run 5 Pregel C | Wt % |
|---|---|---|---|---|---|---|
| Oil | 150 g | 30 | 150 g | 30 | 150 g | 30 |
| Pregel | 75 g | 15 | 75 g | 15 | 75 g | 15 |
| Coal Dust | 275 g | 55 | 275 g | 55 | 275 g | 55 |
| Total | 500 g | | 500 g | | 500 g | |
| Clay | 7.5 g | 1.5 | 7.5 g | 1.5 | 7.5 g | 1.5 |
| Surfactant | 1.5 g | 0.3 | 1.5 g | 0.3 | 1.5 g | 0.3 |
| Clay/ Surfactant | 5/1 | | 5/1 | | 5/1 | |
| Brookfield Visc., cps | | | | | | |
| Initial 10/100 RPM | | 7200/870 | | 12,000/1560 | | 6400/1560 |

-continued

| | | | |
|---|---|---|---|
| 24 hrs. | | | |
| 10/100 RPM | 7600/900 | 12,200/1540 | 5000/880 |
| | | No sediment | |
| | Sl. SN | Sl. SN | 3% SN |
| 1 Week | | | |
| 10/100 RPM | 8400/1010 | 11,700/1580 | 4200/800 |
| | No sed. | No sed. | Sl. sludge |
| | 1% SN | 2% SN | 5% SN |

Runs 3, 4 and 5 in Example 2, having a coal dust concentration of 55% and an added clay concentration of 1.5% showed good rheological properties for all 3 pregels tested.

DIRECT FORMULATION

The following examples were prepared by directly adding the oil, coal dust, clay and surfactant without pregelling. The rheological properties were determined by determining Brookfield viscosities and visual observations as for the earlier examples.

EXAMPLE 3

| | Run 6 | Wt % | Run 7 | Wt % | Run 8 | Wt % |
|---|---|---|---|---|---|---|
| Oil | 216 g | 43.2 | 216 g | 43.2 | 172.8 g | 43.2 |
| Varine O | 1.5 g | 0.3 | — | — | — | — |
| Monazoline T | — | — | 1.5 g | 0.3 | — | — |
| Tergitol NPX | — | — | — | — | 1.2 g | 0.3 |
| Clay | 7.5 g | 1.5 | 7.5 g | 1.5 | 6.0 g | 1.5 |
| Coal Dust | 275 g | 55.0 | 275 g | 55.0 | 220 g | 55.0 |
| | 500 g | | 500 g | | 400.0 g | |
| Clay/ Surfactant | 5/1 | | 5/1 | | 5/1 | |

-continued

| | | | |
|---|---|---|---|
| Brookfield Visc. cps | | | |
| Initial | | | |
| 10/100 RPM | 600/180 | 1250/275 | 2200/460 |
| | Thin | Thin | Med. viscosity |
| 24 hrs. | 700/316 | 800/275 | 1060/300 |
| 10/100 RPM | 10% SN | 5% SN | 5% SN |
| | No sed. | No sed. | No sed. |
| 1 Week | 800/220 | 1200/305 | 1150/330 |
| 10/100 RPM | Sl. sludge* | Sl. sed.* | Sl. sed.* |
| | 20% | 10% | 10% SN |

*easy to redisperse.

Example 3 indicates that the suspensions were too thin to promote good stability over the 1 week test period. This is evidenced by the occurrence of slight sludge and sediment formations in Runs 6, 7 and 8 after 1 week. It should be noted, however, that although some of the coal dust settled in a one week storage period, it was easy to redisperse and was not a hard cake.

The following 2 examples indicate the effect of variations in clay percentages, clay/surfactant ratios and percentage coal dust upon the rheological properties of the resultant suspensions.

EXAMPLE 4

| Surfactant | Run 9 Monazoline T | Wt % | Run 10 Monazoline T | Wt % | Run 11 Tergitol NPX | Wt % |
|---|---|---|---|---|---|---|
| Oil | 212.5 g | 42.5 | 187.5 g | 37.5 | 190.6 g | 38.12 |
| Surfactant | 2.5 g | 0.5 | 2.5 g | 0.5 | 1.9 g | 0.38 |
| Clay | 10.0 g | 2.0 | 10.0 g | 2.0 | 7.5 g | 1.5 |
| Coal Dust | 275.0 g | 55.0 | 300.0 g | 60.0 | 300.0 g | 60.0 |
| | 500.0 g | | 500.0 g | | 500.0 g | |
| Clay/Surfactant | 4/1 | | 4/1 | | 4/1 | |
| Brookfield Visc., cps | | | | | | |
| Initial | | | | | | |
| 10/100 RPM | | | 1500/360 | 10,200/2500 | 11,600/3480 | |
| | | | Thin | Thick | Thick | |
| 24 hrs. | | | | | | |
| 10/100 RPM | | | 1500/440 | 12,400/2880 | 8800/2840 | |
| | | | 5% SN | 2% SN | 2% SN | |
| | | | No sed. | No sed. | No sed. | |

EXAMPLE 5

| | Run 12 Tergitol NPX | Wt % | Run 13 Monazoline T | Wt % | Run 14 Tergitol NPX | Wt % | Run 15 Monazoline T | Wt% |
|---|---|---|---|---|---|---|---|---|
| Oil | 190 g | 38.0 | 190 g | 38.0 | 216.25 g | 43.25 | 216.25 g | 43.25 |
| Surfactant | 2.5 g | 0.5 | 2.5 g | 0.5 | 1.25 g | 0.25 | 1.25 g | 0.25 |
| Clay | 7.5 g | 1.5 | 7.5 g | 1.5 | 7.5 g | 1.5 | 7.5 g | 1.5 |
| Coal Dust | 300 g | 60.0 | 300 g | 60.0 | 275 g | 55.0 | 275 g | 55.0 |
| | 500 g | | 500 g | | 500 g | | 500 g | |
| Clay/Surfactant | 3/1 | | 3/1 | | 6/1 | | 6/1 | |
| | Brookfield Visc., cps | | | | | | | |
| | Initial | | | | | | | |
| | 10/100 RPM | | 10,800/3720 | 4800/1200 | 4800/920 | 2400/520 | | |
| | | | Thick | Thin-med. | Thin | Thin | | |
| | 24 hrs. | | | | | | | |
| | 10/100 RPM | | 12,400/>4000 | 7600/1880 | 2200/600 | 1800/520 | | |
| | | | Trace SN gel | 1% SN | 5% SN | 5% SN | | |

Coal dust-fuel oil slurries having good rheological properties over extended periods of time can be attained by the proper selection of total solids, amount of clay, type of surfactant and clay/surfactant ratio. The pregelling method in which the clay and surfactant were gelled at a high concentration in oil and then stirred into additional oil and coal provided higher viscosities in the final mix for the same quantity of coal and surfactant than when the clay and surfactant were added directly to the coal and oil without pregelling. The high viscosities measured at low shear rates for the examples tested proved that stable suspensions of coal dust in fuel oil over long periods of time can be achieved. The relatively low viscosities of the coal dust-fuel oil suspensions of this invention at higher shear rates are a good indication that the same suspensions can be readily pumped and sprayed under the higher shear conditions encountered in these operations.

Although the invention is directed to providing stable suspensions of coal dust in organic hydrocarbon liquids for the purpose of providing an efficient combustible mixture of coal in oil that is stable and has good pumping properties this is by way of example only. The invention readily finds application when other combustible solid powders are added. Other economical and available powdered combustible solids are coke, gilsonite asphalt, lignite anthracite, cannel coal, and other semi-coalified materials. Useable combustible hydrocarbon liquids range from mineral spirits and kerosene through liquid still bottoms realizing that adjustments in clay usage and clay to surfactant ratio may be necessary.

The use of coal dust suspensions in the range of 50 to 60% by weight is based upon idealized conditions for combustion. Since the BTU output for commercial grade fuel oil is roughly double that for the equivalent weight of coal a 50% addition by weight of coal dust would result in approximately 75% of the BTU output for an equivalent weight of fuel oil alone. Since the coal dust-fuel oil suspension produces a flame having properties between that of fuel oil or coal alone the resulting flame properties can readily be controlled by varying the concentration of coal dust in the coal dust-oil suspension. In order for the suspension to be efficient enough for most commercial burner applications, ranges in coal dust from 35 to 70% should be employed with corresponding ranges in the fuel oil of from 56 to 28% by weight. In order to provide efficient long term stable suspensions of the coal dust in the fuel oil, the quantity of surfactant employed must be correspondingly adjusted along with the proper quantity of clay. For coal dust ranges of 35 to 70% the clay concentration should vary from 0.5 to 3.0% by weight depending upon the amount of coal suspended. The surfactant concentration depending upon the amount of coal dust within the 35 to 70 weight percent range can vary from 1.0 down to as little as 0.1 percent by weight. The ratio of clay to surfactant for all the suggested ranges should be from 3-1 to 7-1 depending upon the quantity of coal dust to be suspended within any given range and the amount of naturally-occurring clay in the coal dust.

I claim:

1. A suspension of carbonaceous combustible solids in a hydrocarbon liquid having a relatively high viscosity at low shear and a relatively low viscosity at high shear comprising:

from 35–70% by weight of carbonaceous combustible solids in particulate form;

from 56–28% by weight of the hydrocarbon liquid;

from 3.0–0.5 weight percent of a gelling grade clay to cause the hydrocarbon liquid to become gelled; and from 1.0–0.1 weight percent of an organic surfactant of the type that will disperse the clay in the liquid and will not prevent reflocculation and formation of a gel structure of the clay particles in the liquid, whereby the surfactant disperses the carbonaceous combustible solids and the clay within the suspension.

2. The suspension of claim 1 wherein the combustible solids are selected from the group consisting of coke, coal and asphalt.

3. The suspension of claim 2 wherein the coal is selected from the group consisting of lignite, bituminous, anthracite and cannel coal.

4. The suspension of claim 3 wherein the coal comprises a coal dust powder having a particle size between 100 and 200 mesh.

5. The suspension of claim 3 wherein the coal contains a volatile content of 40% and an ash content of 7%.

6. The suspension of claim 4 wherein the coal dust is 88% finer than 200 mesh.

7. The suspension of claim 1 wherein the hydrocarbon liquid is selected from the group consisting of fuel oil, mineral spirits, and kerosene.

8. The suspension of claim 1 wherein the surfactant is a cationic surfactant.

9. The suspension of claim 8 wherein the cationic surfactant is formed by the reaction of a fatty acid selected from a group consisting of oleic acid and tall oil fatty acids and aminoethylethanolamine.

10. The suspension of claim 7 wherein the surfactant is a nonionic surfactant.

11. The suspension of claim 10 wherein the surfactant is formed by the reaction of dodecylphenol with ethylene oxide.

12. The suspension of claim 1 wherein the clay is selected from the group consisting of attapulgite, Wyoming bentonite, and sepiolite.

13. A coal dust suspension in fuel oil having a high viscosity at low shear and a low viscosity at high shear comprising:

50–60% by weight of finely divided coal dust;

37–48 weight percent fuel oil;

1.0–2.0 weight percent attapulgite clay for causing the fuel oil to become gelled; and 0.2–0.8 weight percent of a surfactant for dispersing both the clay and the coal dust within the fuel oil.

14. A method of making a coal dust suspension in a hydrocarbon organic liquid having a high viscosity at low shear and a low viscosity at high shear comprising the steps of:

providing from 56 to 28% by weight of a hydrocarbon organic liquid;

dissolving from 1.0 to 0.1 weight percent of a surfactant in the hydrocarbon organic liquid;

adding from 3.0 to 0.5 weight percent of a gelling grade clay to the hydrocarbon organic liquid to cause the hydrocarbon organic liquid to become gelled; and adding from 35 to 70% by weight of a finely powdered coal dust to the gelled hydrocarbon organic liquid.

15. The method of claim 14 wherein the clay-to-surfactant ratio is from 3/1 to 7/1.

* * * * *